US006714167B1

(12) United States Patent
Gusick, Jr.

(10) Patent No.: US 6,714,167 B1
(45) Date of Patent: Mar. 30, 2004

(54) SATELLITE DISH COVER

(76) Inventor: Raymond M. Gusick, Jr., 706 Emerald St., Lowell, AR (US) 72745

( * ) Notice: Subject to any disclaimer, the term of this patent is extended or adjusted under 35 U.S.C. 154(b) by 0 days.

(21) Appl. No.: 10/223,162

(22) Filed: Aug. 19, 2002

(51) Int. Cl.[7] ..... H01Q 1/42
(52) U.S. Cl. ..... 343/872
(58) Field of Search ..... 343/704, 840, 343/872

(56) References Cited

U.S. PATENT DOCUMENTS

| | | | | | |
|---|---|---|---|---|---|
| 4,282,530 | A | | 8/1981 | Semplak | 343/784 |
| D304,454 | S | * | 11/1989 | Serres | D14/231 |
| 5,451,972 | A | | 9/1995 | Franklin | 343/840 |
| 5,528,253 | A | | 6/1996 | Franklin | 343/840 |
| 5,815,125 | A | * | 9/1998 | Kelly et al. | 343/872 |
| D402,990 | S | * | 12/1998 | Kelly et al. | D14/230 |
| 5,940,047 | A | * | 8/1999 | Pfnister | 343/872 |
| D418,143 | S | | 12/1999 | Thaw | D14/230 |
| 6,191,753 | B1 | * | 2/2001 | Ellis et al. | 343/872 |
| D445,780 | S | | 7/2001 | Thaw | D14/230 |
| D453,328 | S | | 2/2002 | Thaw | D14/230 |

* cited by examiner

*Primary Examiner*—Don Wong
*Assistant Examiner*—Shih-Chao Chen
(74) *Attorney, Agent, or Firm*—Frank J. Catalano

(57) ABSTRACT

In a cover for a satellite dish, a broad piece of fabric which coincides with the rim of the dish is hemmed by a narrow band of fabric which is folded lengthwise with a drawstring in the fold. Preferably, the ends of the narrow band are spaced apart so the dish support structure can be inserted in the space and between the drawstring and the broad piece of fabric. The drawstring is adjustable into a first large loop to receive the concave face and rim of the dish and a second small loop less than the broad piece perimeter for tautly girting the hem against the rim of the dish, preferably with the hem tautly girt in the rim of the dish. Visual information may be displayed on an outer surface of the broad piece of fabric.

9 Claims, 2 Drawing Sheets

SATELLITE DISH COVER

BACKGROUND OF THE INVENTION

This invention relates generally to accessories for satellite dishes and more particularly concerns a cover to protect and decorate a satellite dish.

Known satellite dish covers are lacking in durability and not well suited to some decorative purposes. Covers which are made of plastic or other rigid or brittle material tend to splinter, chip or crack when struck with sufficient force by debris such as falling tree branches. On the other hand, covers which are made of moderately stretchable fabric tend to break down the composition or distort the appearance of visual information decorating their surface as the fabric is stretched and released. Furthermore, fabric covers are generally configured so as to have their decorated panel of fabric tautly drawn against the rim of the dish, creating an accelerated wear line on the cover along the points of contact with the dish. Heavier fabric is required to maintain a suitable life expectancy for the cover. Also, since the fabric is moderately stretchable, if it is not very tautly drawn against the rim of the dish, high winds can blow the cover off the dish. In addition to strength of material problems, known covers are generally constructed so as to also cover the feeder support structure and receiver associated with the dish. Therefore, no sizable flat surface is presented on which to clearly display visual information.

It is, therefore, an object of this invention to provide a satellite dish cover which is durable. Another object of this invention is to provide a satellite dish cover which is not rigid or brittle and subject to splintering, chipping or cracking. A further object of this invention is to provide a satellite dish cover which is made of substantially non-stretchable fabric. Yet another object of this invention is to provide a satellite dish cover which does not stretch and contract to such an extent as to break down the composition or distort the appearance of visual information decorating its surface. It is also an object of this invention to provide a satellite dish cover which provides a large flat display surface across the concave surface of the dish. Still another object of this invention is to provide a satellite dish cover having a hem positioned to reinforce the anticipated wear line along the rim of dish. An additional object of this invention is to provide a satellite dish cover which will remain connected to the dish assembly even if the cover is blown off or otherwise inadvertently detached from the dish.

SUMMARY OF THE INVENTION

In accordance with the invention, a cover is provided for a satellite dish. A broad piece of fabric is cut to a perimeter which overlaps or preferably coincides with the rim of the dish when the piece of fabric is tautly disposed across the concave face of the dish. A narrow band of fabric is cut to a length equal to or preferably less than that of the broad piece perimeter. A drawstring is disposed between flaps formed by folding the narrow band lengthwise. The ends of the drawstring extend beyond the ends of the narrow band. A hem secures the lengthwise edges of the narrow band to the broad piece perimeter. In the preferred embodiment in which the length of the band is less than the broad piece perimeter, the ends of the narrow band will be spaced apart so that the support structure of the dish can be received in the space and between the drawstring and the broad piece of fabric. A mechanism is provided to connect the ends of the drawstring to form a continuous loop adjustable between a first length greater than the broad piece perimeter to receive the concave face and rim of the dish therein and a second length less than the broad piece perimeter for tautly girting the broad piece of fabric against the rim of the dish. In the preferred embodiment in which the perimeter of the broad piece coincides with the rim of the dish, the hem will tautly girt the rim of the dish. Preferably, the broad piece of fabric is substantially non-stretchable. Visual information may be displayed on an outer surface of the broad piece of fabric.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
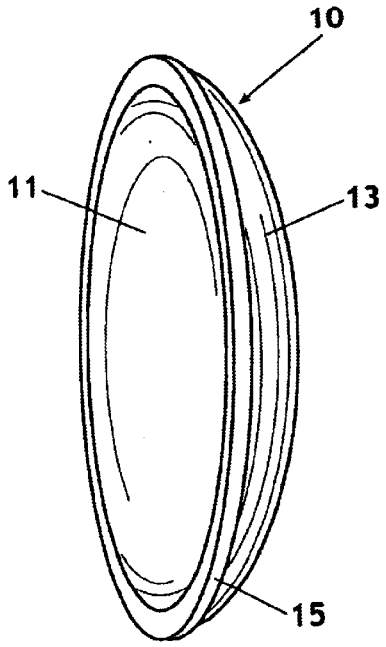
Fig. 1 ( PRIOR ART )
FIG. 1 is a side perspective view illustrating a typical satellite dish.

Turning first to FIG. 1, a typical satellite dish 10 is illustrated. For the purposes of the present description, the important components of the dish 10 are its concave and convex faces 11 and 13, respectively, and a peripheral rim 15 along the front edge of the concave face 11 and extending rearwardly to the convex face 13.

Figure 2:
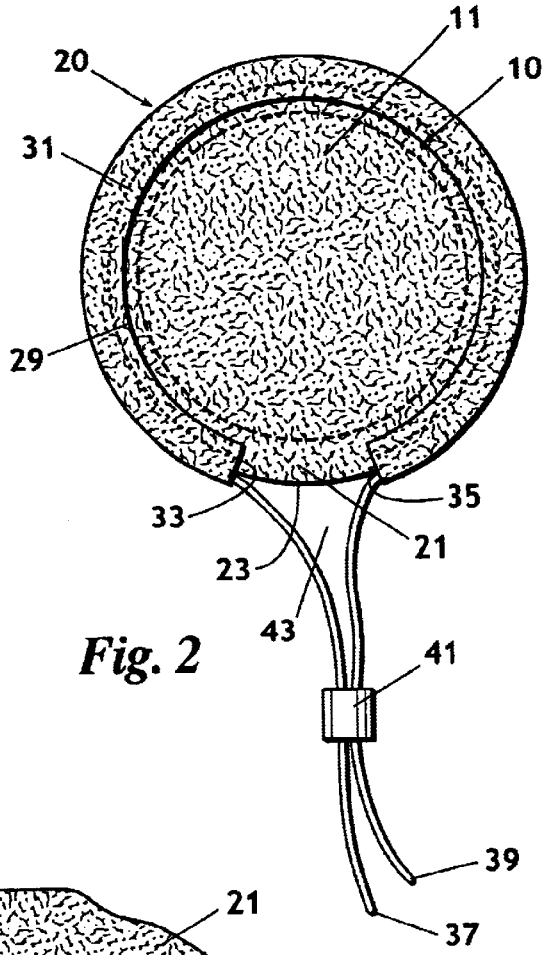
FIG. 2 is a plan view of a cover disposed in a single plane over the concave face of the satellite dish.
Figure 3:
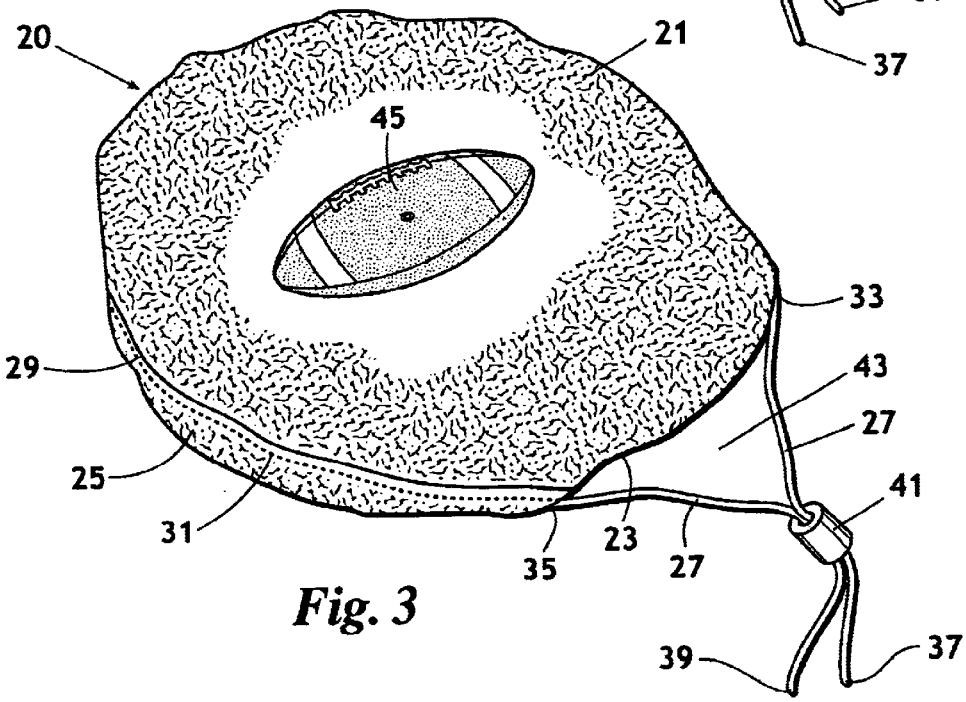
FIG. 3 is a top perspective view of the cover of FIG. 2.

Turning to FIGS. 2 and 3, a cover 20 for the satellite dish 10 is made from a broad piece of fabric 21 which, as is best seen in FIG. 2, has a perimeter 23 which coincides with or overlaps the rim 15 of the dish 10 when the broad piece of fabric 23 is tautly disposed across the concave face 11 of the dish 10. A narrow band of fabric 25 is folded lengthwise over itself. A drawstring 27 is disposed between the flaps formed by folding the narrow band of fabric 25. Preferably, and as shown, the length of the narrow band of fabric 25 is less than that of the perimeter 23 of the broad piece of fabric 21, though it could be the same length. The lengthwise edges 29 of the narrow band of fabric 25 are secured to the perimeter 23 of the broad piece of fabric by a hem 31, closing the flaps of the folded band 25 to form a tube in which the drawstring 27 can slide. If, as preferred and shown, the length of the band 25 is less than that of the perimeter 23, then the ends 33 and 35 of the band 25 are spaced apart on the perimeter 23 of the broad piece of fabric 21. Whether or not the length of the band 25 is less than the perimeter 23 of the broad piece of fabric 21, the ends 37 and 39 of the drawstring 27 extend beyond their respective ends 33 and 35 of the band 25. The ends 37 and 39 of the drawstring 27 are also extended through a connector 41 so as to form the drawstring 27 into an adjustable continuous loop. Any known mechanism for variably adjusting the size of a loop of a drawstring may be used for this purpose, as long as the connector permits adjustment of the continuous loop between a first length which is greater than the perimeter 23 of the broad piece of fabric 21 and a second length which is less than the perimeter 23 of the broad piece of fabric 21. If, as preferred and shown, the ends 33 and 35 of the band 25 are spaced apart, then the portion of the perimeter 23 between the ends 33 and 35 of the band together with the portions of the drawstring 27 disposed above the connector 41 define an opening 43, the purpose of which is hereinafter explained. It is preferred that the broad piece of fabric 21 be substantially non-stretchable. By substantially non-stretchable, it is intended that, if the broad piece of fabric 21 is cut to coincide with the inner edge of the rim 15, when the broad piece of fabric 21 is tautly stretched across the concave surface 11 of the dish 10, the perimeter of the broad piece of fabric 21 will not overlap the outer edge of the rim 15. In the prototype cover, the use of 200 denier nylon or pack cloth for the broad piece of fabric 21, 400 denier nylon or pack cloth for the narrow band of fabric 25 and ⅛ inch nylon drawstring cord for the drawstring 27 with a ⅛ inch cord lock as the connector 41 were found to be acceptable to cover a dish approximately 18 inches in diameter. Typically, dishes are not perfectly circular, though they are generally defined in relation to a dish diameter. It is anticipated that the broad piece of fabric 21 will be cut by a computer controlled cutting process using the specific manufacturer's data for the contour of the rim 15 of the dish 10. As seen in FIG. 3, the broad piece of fabric 21 may be used to display visual information, such as the football 45 illustrated. In the prototype, the visual information 45 was applied by a silk screening process. Since the broad piece of fabric 21 is substantially nonstretchable, any distortion of the appearance of the visual information 45 or breakdown of the composition of visual information 45 is minimal.

Figure 4:
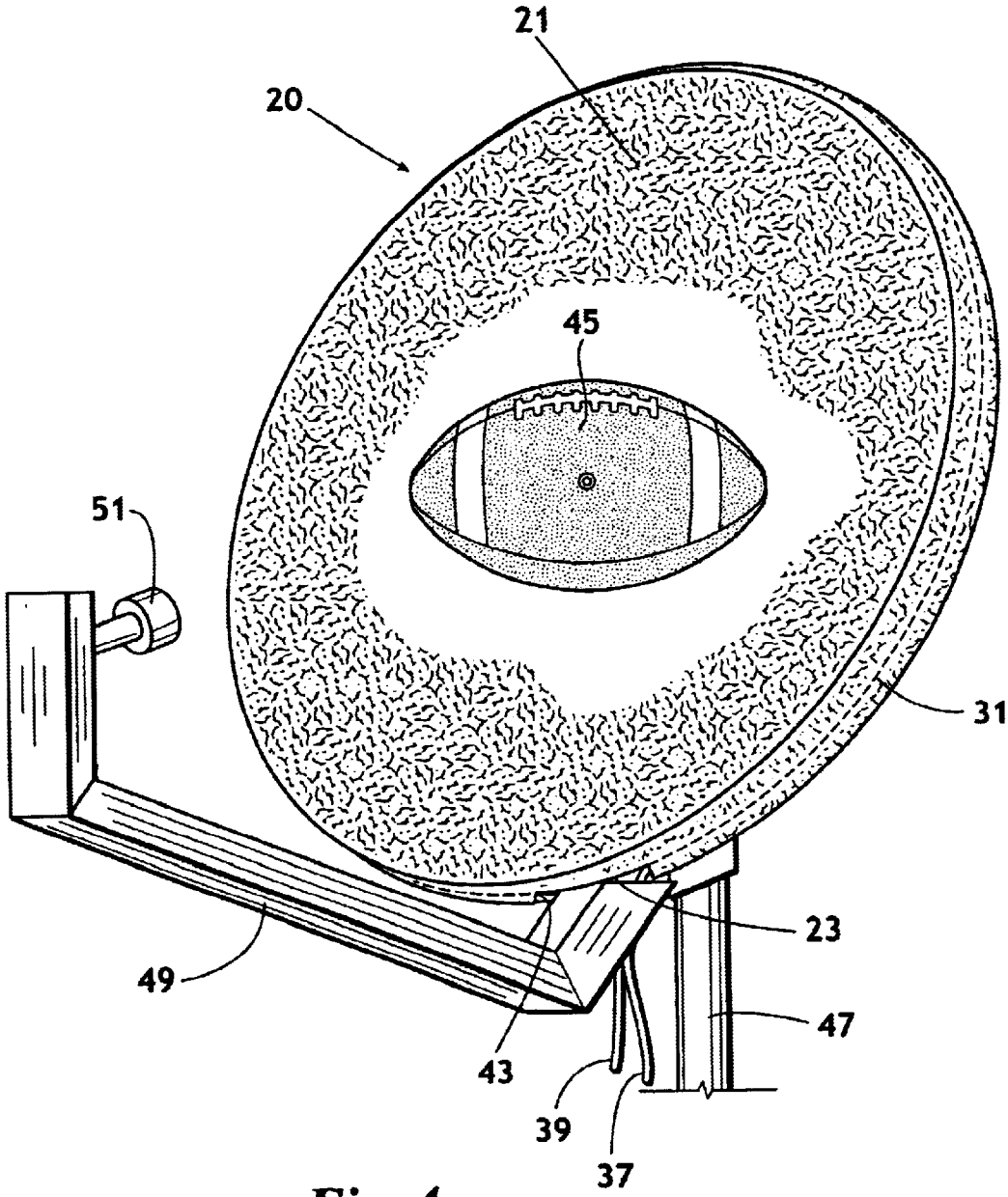
FIG. 4 is a front perspective view of the cover of FIG. 2 mounted on the dish.

Turning to FIG. 4, the manner of mounting the cover 20 on the dish 10 will be understood. The dish of FIG. 4 is mounted on an upright support member 47 and a support arm 49 extends forwardly of the dish to the feeder housing 51. The cover 20 is shown in its mounted condition. To achieve this condition, the feeder housing 51 and feeder support structure 49 were fed through the opening 43 defined by the perimeter 23 of th broad piece of fabric 21 and the portions of the drawstring 27 above the connector 41. The connector 41 was positioned on the drawstring 27 so that the length of the continuous loop of the drawstring 27 was greater than the perimeter 23 of the broad piece of fabric 21 and of the peripheral rim 15 of the dish 10. The concave face 11 of the dish 10 was inserted through the continuous loop of the drawstring 27 and into the cover 10 so that the broad piece of fabric 21 extended in a substantially flat or planar condition across the concave face 11 of the dish 10. With the broad piece of fabric 21 thus positioned across the concave face 11 of the dish 10, the connector 41 was repositioned on the drawstring 27 to reduce the length of the continuous loop of the drawstring 27 so as to tautly girt the broad piece of fabric 21 against the rim 15 of the dish 10. This can be accomplished so long as the broad piece of fabric 21 overlaps the rim 15 of the dish 10. However, if as preferred and shown, the broad piece of fabric 21 is cut to coincide with the rim 15 of the dish 10, then, as the broad piece of fabric 21 is tautly drawn over the rim 15, the hem 31 will abut the rim 15. Thus, the flaps of the narrow band of fabric 25, the perimeter 23 of the broad piece of fabric 21 and the hem 31 provide additional strength to the cover 20 along the wear line of the cover 20 against the rim 15. Furthermore, since the feeder support structure 49 extends through the opening 43 defined by the perimeter 23 of the broad piece of fabric 21 and the drawstring 27 above the connector 41, if the cover 20 should be separated from the dish 10, such as by high winds or falling debris, the cover 20 will remain attached to the support structure 49. It should also be noted that the planar relationship of the broad piece of fabric 21 across the concave face 11 of the dish 10 provides a large, flat surface extremely suitable for the display of visual information 45.

Thus, it is apparent that there has been provided, in accordance with the invention, a satellite dish cover that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A cover for a satellite dish having a concave face, a convex face and a peripheral rim therebetween comprising a broad piece of fabric having a perimeter which coincides with the rim of the dish when said piece of fabric is tautly disposed across the concave face of the dish, a narrow band of fabric of length less than said broad piece perimeter, a draw string disposed between flaps formed by folding said narrow band lengthwise and having ends thereof extending beyond respective ends of said narrow band, a hem securing lengthwise edges of said narrow band to said broad piece perimeter with said ends of said narrow band spaced apart for receiving a support structure of said dish therebetween and means connecting said ends of said draw string to form a continuous loop adjustable between a first length greater than said broad piece perimeter to receive the concave face and rim of the dish therein and a second length less than said broad piece perimeter for tautly girting said hem against the rim of the dish.

2. A cover according to claim 1, said broad piece of fabric being substantially non-stretchable.

3. A cover according to claim 1 further comprising visual information displayed on an outer surface of said broad piece of fabric.

4. A cover for a satellite dish having a concave face, a convex face and a peripheral rim therebetween comprising a broad piece of fabric having a perimeter which overlaps the rim of the dish when said piece of fabric is tautly disposed across the concave face of the dish, a narrow band of fabric of length less than said broad piece perimeter, a draw string disposed between flaps formed by folding said narrow band lengthwise and having ends thereof extending beyond respective ends of said narrow band, a hem securing lengthwise edges of said narrow band to said broad piece perimeter with said ends of said narrow band spaced apart for receiving a support structure of said dish therebetween and means connecting said ends of said draw string to form a continuous loop adjustable between a first length greater than a length of a perimeter of said rim to receive the concave face and rim of the dish therein and a second length less than said length of said perimeter of said rim for tautly girting said broad piece of fabric against the rim of the dish.

5. A cover according to claim 4, said broad piece of fabric being substantially non-stretchable.

6. A cover according to claim 4 further comprising visual information displayed on an outer surface of said broad piece of fabric.

7. A cover for a satellite dish having a concave face, a convex face and a peripheral rim therebetween comprising a broad piece of fabric having a perimeter which coincides with the rim of the dish when said piece of fabric is tautly disposed across the concave face of the dish, a narrow band of fabric folded lengthwise, a draw string disposed in said folded narrow band and having ends thereof extending beyond respective ends of said narrow band, a hem securing lengthwise edges of said narrow band to said broad piece perimeter and means connecting said ends of said draw string to form a continuous loop adjustable between a first length greater than said broad piece perimeter to receive the concave face and rim of the dish therein and a second length less than said broad piece perimeter for tautly girting said hem against the rim of the dish.

8. A cover according to claim 7, said broad piece of fabric being substantially non-stretchable.

9. A cover according to claim 7 further comprising visual information displayed on an outer surface of said broad piece of fabric.

* * * * *